US006264001B1

(12) United States Patent
Herschbach

(10) Patent No.: US 6,264,001 B1
(45) Date of Patent: Jul. 24, 2001

(54) SCAFFOLDING HANGER

(76) Inventor: Robert Herschbach, 24614 Palermo Way, Valencia, CA (US) 91355

( * ) Notice: Subject to any disclaimer, the term of this patent is extended or adjusted under 35 U.S.C. 154(b) by 0 days.

(21) Appl. No.: 09/477,613

(22) Filed: Jan. 4, 2000

(51) Int. Cl.[7] ..... E04G 3/10
(52) U.S. Cl. ..... 182/150; 182/142
(58) Field of Search ..... 182/150, 82, 142, 182/145

(56) References Cited

U.S. PATENT DOCUMENTS 4,413,707 * 11/1983 Lienhard ..... 182/150
4,815,563 * 3/1989 Puccinelli ..... 182/150
5,145,032 * 9/1992 Puccinelli ..... 182/142

* cited by examiner

*Primary Examiner*—Alvin Chin-Shue

(74) *Attorney, Agent, or Firm*—David A. Belasco; Beehler & Pavitt

(57) ABSTRACT

A scaffolding hanger is described. The invention is a refinement of scaffolding hangers used to support catwalks and recording equipment for use on television and film production sets. The hangers are suspended from hooks by chains attached to a ceiling. Catwalk platforms are supported upon the lower connecting platform between the front and rear upright members of the hanger. The weight of the catwalk and hangers is supported by the rear upright members and center upright members. The center upright members are set back from the front edge of the catwalk in order to provide clearance for recording equipment attached to a rail system secured to the front portion of the catwalk. A front upright member is of abbreviated height in order allow the recording equipment to be moved from one end of a production set to another along the suspended catwalk platforms without interference from the upright members of the scaffolding supports. Means are provided for securing the catwalk platforms to the scaffolding hangers and for attaching safety railings to the rear and center upright members.

7 Claims, 4 Drawing Sheets

138
74
82
142
150
22
78
14
30
154
146
10
18
48
66
70
38
46
62
34
58
174
162
158
182
186
178
102
90
190
230
194
106
118
54
170
126
110
122
242
246
166
98
86
26
134
130

SCAFFOLDING HANGER

FIELD OF INVENTION

The invention pertains to scaffolding hangers for use in the production of television programming or feature films. More particularly, the invention relates to scaffolding hangers that will permit the use of track-mounted sound booms and microphones or cameras by providing clearance for the sound boom or camera tracks.

BACKGROUND OF THE INVENTION

Various devices have been developed to permit sound recording or filming on production sets or sound stages used for television and feature film production. On a typical production set, sound and image recording equipment such as "sound booms" or cameras are mounted on catwalks supported by scaffolding hangers suspended from chains attached to the ceiling of the sound stage building. The scaffolding hangers typically include a pair of upright supports, one at the front of the hanger and one at the rear. Horizontal cross members are fixedly attached at the top and bottom of the upright supports. Planking is affixed to the lower horizontal cross members to provide the catwalk surface.

Recording equipment is typically affixed to the catwalk surface with swivel mountings and a number of recording devices are typically needed to insure coverage from all vantage points on the catwalks. Systems have been developed for mounting recording equipment on wheeled "trucks" that can travel along a track mounted to the catwalks. Using these systems, less recording equipment is required as the equipment may be moved along the track to provide recording coverage at varying locations. However, the recording equipment used tends to be large, particularly the sound booms. It is desirable that the equipment be placed as far forward on the catwalks (closest to the set) as possible. Using the prior art scaffolding hangers causes a problem when used in conjunction with track-mounted recording systems, as the track must be mounted behind the front upright support. These front upright supports cause a problem because the recording equipment is unable to slide easily past the uprights on the track without considerable adjustments. As a consequence, multiple sets of recording equipment are required, i.e., one set for every pair of scaffolding supports. As this equipment is very expensive to use and maintain, such a requirement greatly increases production costs.

Some of the prior art inventions developed to allow positioning of recording equipment at a production set include the following: U.S. Pat. No. 5,757,943 issued to Arledge, Jr. is directed to a movable microphone boom mounting device for mounting on a catwalk located above a stage. The boom is mounted to a rolling carriage that moves along a track attached to the catwalk. The boom's movement is limited by the uprights of the scaffolding supports to which the catwalk is attached.

U.S. Pat. No. 4,710,819 issued to Brown, is a cable suspension system for supporting and conveying equipment such as a camera for use within a defined space. This system does not permit hands-on control of the suspended recording equipment. U.S. Pat. No. 5,715,755, issued to Jonischkeit et al. is directed to a traveling carriage movable on a guide rod for positioning a spotlight in film recording studios. U.S. Pat. No. 5,671,932, issued to Chapman, is directed to a camera crane for use in motion picture and television productions. The crane has a mast on a wheeled chassis that has a supporting base providing for minimum interference with the boom it supports. U.S. Pat. No. 4,093,078 issued to Radek is directed to a metal skeletal tandem frame construction that has an intermediate upright that provides unencumbered access. The end supports, however, would interfere with any recording equipment movably supported by the structure. U.S. Pat. No. 5,778,999, issued to Nealeigh, is a scaffold extension and enclosure system that includes a cantilevered platform supported by a series of angular brackets. This system must be braced against a structure and/or the roof of the structure for support.

While other variations exist, the above-described designs for systems to support recording equipment over a production set are typical of those encountered in the prior art. It is an objective of the present invention to provide a system of scaffolding support that allows for the use of track-mounted recording equipment without interference from scaffolding support uprights, so as to minimize the amount of such equipment required. It is a further objective to provide a scaffolding support system that includes means for securing catwalks to the scaffolding supports. It is a still further objective of the invention to provide the above-described capabilities in using scaffolding supports that are lightweight, durable and inexpensive to produce. It is yet a further objective to provide scaffolding supports that will work easily within existing scaffolding suspension systems and that will accommodate standardized catwalks and recording equipment.

While some of the objectives of the present invention are disclosed in the prior art, none of the inventions found include all of the requirements identified.

SUMMARY OF THE INVENTION

The present invention addresses all of the deficiencies of prior art weighing and counting inventions and satisfies all of the objectives described above.

A scaffolding support providing the desired features may be constructed from the following components. A rear upright member is provided. The rear upright has a first predetermined length, an upper end, a lower end, an inner side and first and second side surfaces. A center upright member is provided. The center upright has a second predetermined length less than the first predetermined length, an upper end, a lower end, an inner side, an outer side, first and second side surfaces and is spaced from and parallel to the rear upright. An upper connecting member is provided. The upper member has a first end, a second end and is fixedly attached at its first end adjacent the upper end of the rear upright and is fixedly attached between its first end and its second end to the upper end of the center upright.

A front upright member is provided. The front upright has a third predetermined length less than the first predetermined length, a first end, a second end, an inner side, an outer side and is parallel to the center upright. A lower connecting platform is provided. The lower platform has an upper surface, a lower surface, a first end, a second end and is fixedly attached at its first end adjacent the lower end of the rear upright and is fixedly attached at its second end to the second end of the front upright.

Means are provided for attaching the lower end of the center upright to the lower connecting platform between its first end and its second end. First and second connection means are provided. The first connection means is fixedly attached at the upper end of the rear upright. The second connection means is fixedly attached adjacent the second end of the upper connecting member.

An upper reinforcing strut is provided. The upper strut extends from a first point adjacent the second end of the upper connecting member to a second point between the upper end of the center upright and the lower end of the center upright. A lower reinforcing strut is provided. The lower strut has a first end and a second end and extends from a third point adjacent the second end of the front upright to a fourth point between the lower end of the center upright and the upper end of the center upright, the fourth point is spaced from the second point.

A horizontal reinforcing strut is provided. The horizontal strut extends from a fifth point located between the first end of the front upright and the second end of the front upright to a sixth point located between the first end and the second end of the lower reinforcing strut. First and second restraining means are provided. The first restraining means is pivotally mounted adjacent the lower end of the rear upright. The second restraining means is pivotally mounted adjacent the second end of the front upright.

When at least two scaffolding hangers are suspended from their connection means parallel to each other and spaced from one another by the length of a catwalk platform, the catwalk is located upon the lower connecting platform between the rear upright and the front upright and secured thereto by the restraining means, thereby forming a stable platform, a track system is secured to the catwalk between the center upright and the front upright, thereby permitting recording equipment to be moved on the track system past the center upright without interference.

In a variant of the invention, the lower connecting platform further includes a first attachment plate. The first plate is fixedly attached to the inner side of the rear upright perpendicular to the upper connecting member. A second attachment plate is provided. The second plate is fixedly attached to the inner side of the front upright perpendicular to the upper connecting member. At least one support member is provided. The support member has a first end, a second end, and is fixedly attached between the first attachment plate and the second attachment plate, parallel to the upper connecting member.

In another variant of the invention, the means for attaching the lower end of the center upright to the lower connecting platform further includes a gusset. The gusset is formed of plate material of a first predetermined width. The gusset has a vertical edge and an orthogonal horizontal edge and is fixedly attached at its vertical edge to one of the inner side and the outer side of the center upright and is fixedly attached at its horizontal edge to the upper surface of the lower connecting platform.

When adjacent catwalk platforms are mounted on the scaffolding support, the platforms will abut closely to one another, being separated only by the width of the gusset.

In yet a further variant, the first and second connection means include hooks for attachment to suspension chains.

A further variant of the invention includes means for attaching safety railings to the rear upright and to the center upright.

In still a further variant, the means for attaching safety railings to the rear upright and to the center upright further includes a series of tubes. The tubes have a longitudinal axis and are fixedly attached to the first and second side surfaces of the rear and center uprights. The tubes are sized, shaped and located to accommodate a series of brackets. The brackets are sized and shaped to support the safety railings. When the brackets are located in the tubes, a series of safety railings is removably supported by the rear and center uprights.

In a final variant of the invention, the first and second restraining means further include a U-shaped bracket. The bracket has first and second side portions and a base portion. The side portions have a first end and a second end, and are pivotally mounted to one of the rear upright and the lower reinforcing strut adjacent the first ends of the side portions. The bracket includes a series of orifices in the base portion. The orifices are sized, shaped and located to accommodate nails for securing the bracket to a catwalk. When the catwalk is positioned upon the lower connecting platform, the brackets pivoted downwardly to contact the catwalk, and nails are driven through the orifices and into the catwalk, the catwalk will be secured from movement with respect to the scaffolding support.

DETAILED DESCRIPTION OF THE PREFERRED EMBODIMENT

Figure 1:
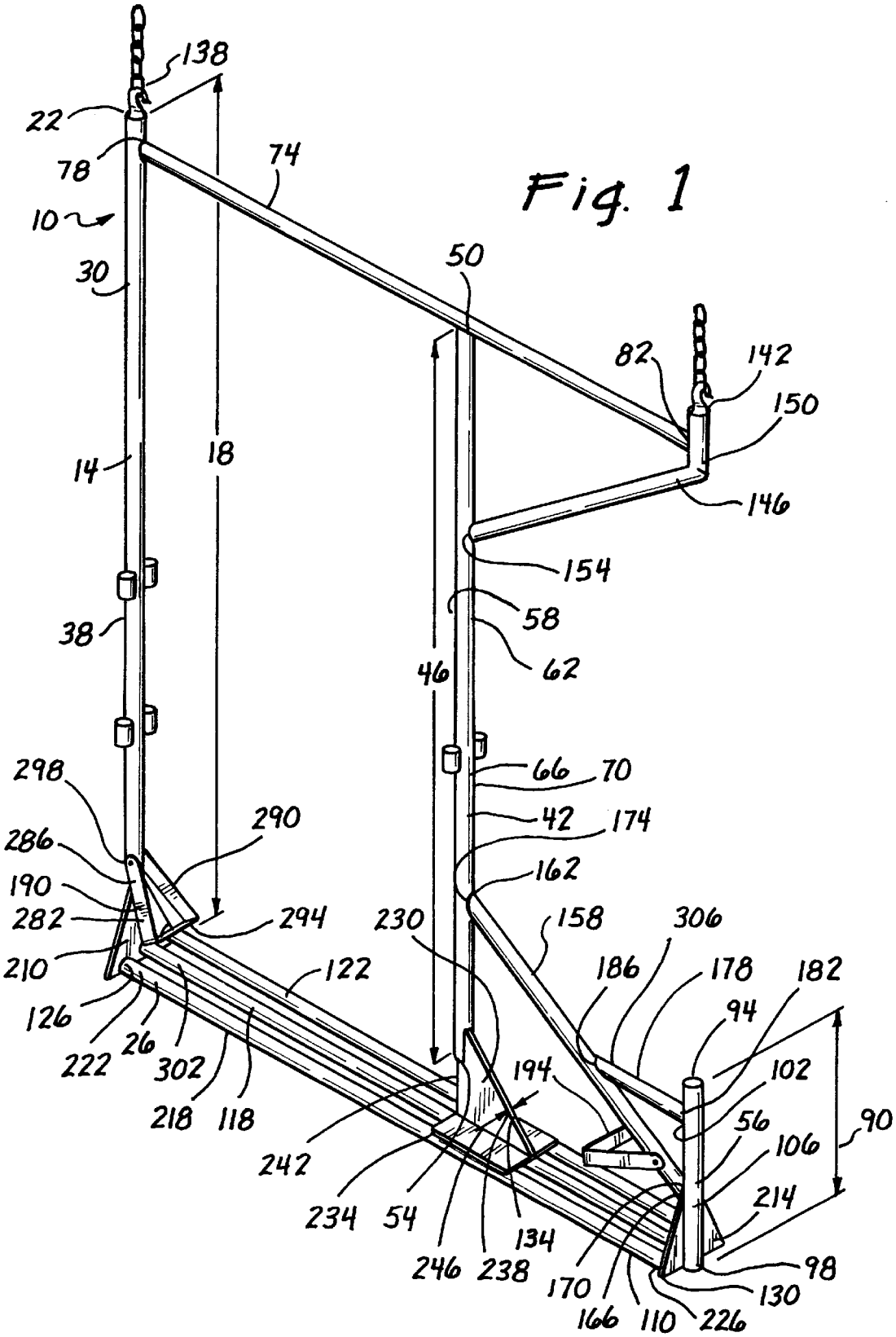
FIG. 1 is a perspective view of the preferred embodiment of the invention.
Figure 2:
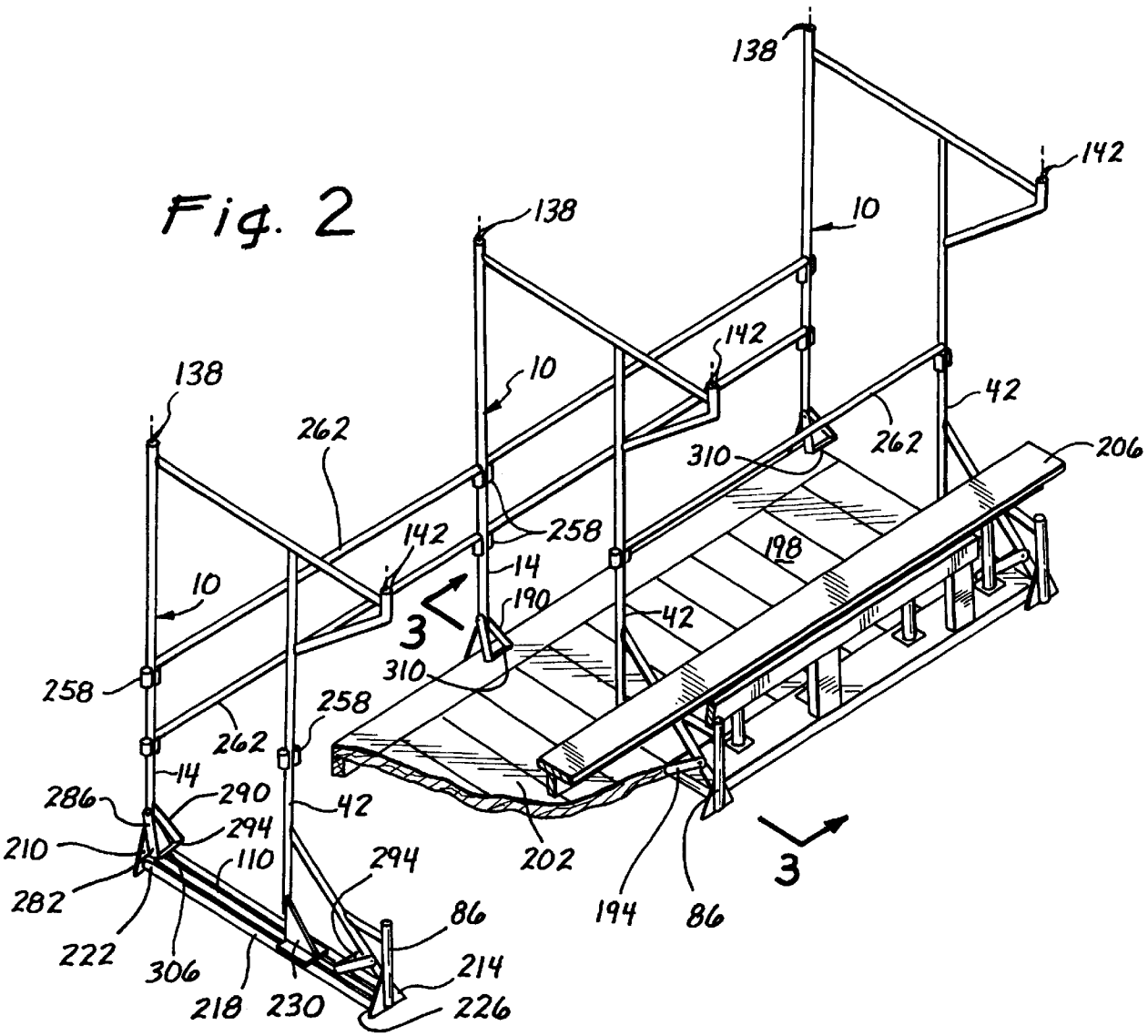
FIG. 2 is a perspective view of the FIG. 1 embodiment illustrating the invention with a catwalk platform and safety railings.
Figure 3:
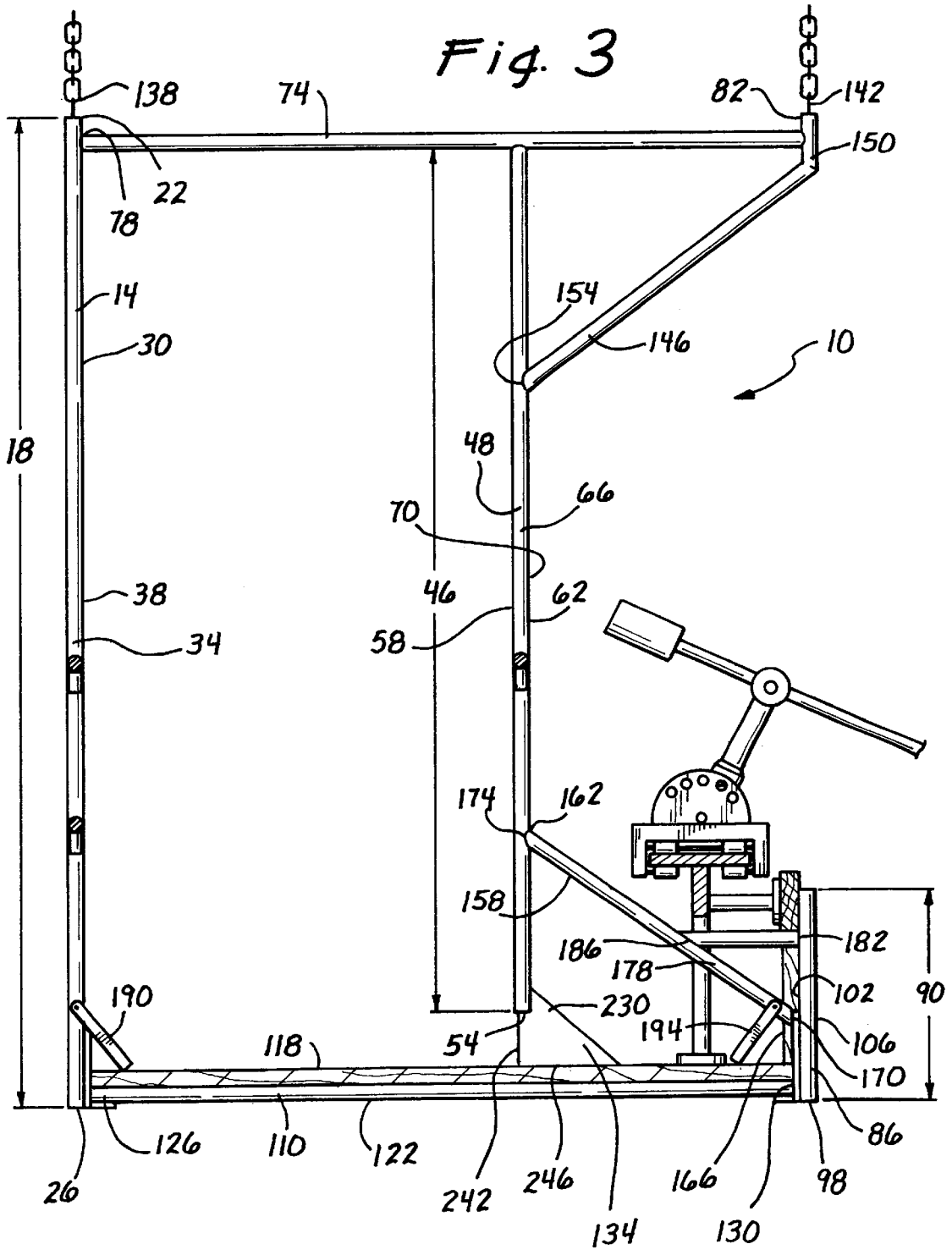
FIG. 3 is a side elevation of the FIG. 1 embodiment illustrating the invention with a rail system and sound recording boom installed.

FIGS. 1–5 illustrate a scaffolding support 10 providing the desired features. As shown in FIGS. 1 and 3, a rear upright member 14 is provided. The rear upright 14 has a first predetermined length 18, an upper end 22, a lower end 26, an inner side 30 and first 34 and second 38 side surfaces. A center upright member 42 is provided. The center upright 42 has a second predetermined length 46 less than the first predetermined length 18, an upper end 50, a lower end 54, an inner side 58, an outer side 62, first 66 and second 70 side surfaces and is spaced from and parallel to the rear upright 14. An upper connecting member 74 is provided. The upper member 74 has a first end 78, a second end 82 and is fixedly attached at its first end 78 adjacent the upper end 22 of the rear upright 14 and is fixedly attached between its first 78 end and its second end 82 to the upper end 50 of the center upright 42.

A front upright member 86 is provided. The front upright 86 has a third predetermined length 90 less than the first predetermined length 18, a first end 94, a second end 98, an inner side 102, an outer side 106 and is parallel to the center upright 42. A lower connecting platform 110 is provided. The lower platform 110 has an upper surface 118, a lower surface 122, a first end 126, a second end 130 and is fixedly attached at its first end 126 adjacent the lower end 26 of the rear upright 14 and is fixedly attached at its second end 130 to the second end 98 of the front upright 86.

Means 134 are provided for attaching the lower end 54 of the center upright 42 to the lower connecting platform 110 between its first end 126 and its second end 130. First 138 and second 142 connection means are provided. The first connection means 138 is fixedly attached at the upper end 22 of the rear upright 14. The second connection means 142 is fixedly attached adjacent the second end 82 of the upper connecting member 74.

An upper reinforcing strut 146 is provided. The upper strut 146 extends from a first point 150 adjacent the second end 82 of the upper connecting member 74 to a second point 154 between the upper end 50 of the center upright 42 and the lower end 54 of the center upright 42. A lower reinforcing strut 158 is provided. The lower strut 158 has a first end 162 and a second end 166 and extends from a third point 170 adjacent the second end 98 of the front upright 86 to a fourth point 174 between the lower end 54 of the center upright 42 and the upper end 50 of the center upright 42, the fourth point 174 is spaced from the second point 154.

A horizontal reinforcing strut 178 is provided. The horizontal strut 178 extends from a fifth point 182 located between the first end 94 of the front upright 86 and the second end 98 of the front upright 86 to a sixth point 186 located between the first end 162 and the second end 166 of the lower reinforcing strut 158. First 190 and second 194 restraining means are provided. The first restraining means 190 is pivotally mounted adjacent the lower end 26 of the rear upright 14. The second restraining means 194 is pivotally mounted adjacent the second end 98 of the front upright 86.

As illustrated in FIG. 2, when at least two scaffolding hangers 10 are suspended from their connection means 138, 142 parallel to each other and spaced from one another by the length of a catwalk platform 198, the catwalk 198 is located upon the lower connecting platform 110 between the rear upright 14 and the front upright 86 and secured thereto by the restraining means 190, 194, thereby forming a stable platform 202, a track system 206 is secured to the catwalk 198 between the center upright 42 and the front upright 86, thereby permitting recording equipment to be moved on the track system 206 past the center upright 42 without interference.

In a variant of the invention, illustrated in FIGS. 1 and 2, the lower connecting platform 110 further includes a first attachment plate 210. The first plate 210 is fixedly attached to the inner side 30 of the rear upright 14 perpendicular to the upper connecting member 74. A second attachment plate 214 is provided. The second plate 214 is fixedly attached to the inner side 102 of the front upright 86 perpendicular to the upper connecting member 74. At least one support member 218 is provided. The support member 218 has a first end 222, a second end 226, and is fixedly attached between the first attachment plate 210 and the second attachment plate 214, parallel to the upper connecting member 74.

In another variant of the invention, the means 134 for attaching the lower end 54 of the center upright 42 to the lower connecting platform 110 further includes a gusset 230. The gusset 230 is formed of plate material 234 of a first predetermined width 238. The gusset 230 has a vertical edge 242 and an orthogonal horizontal edge 246 and is fixedly attached at its vertical edge 242 to one of the inner side 58 and the outer side 62 of the center upright 42 and is fixedly attached at its horizontal edge 246 to the upper surface 118 of the lower connecting platform 114.

When adjacent catwalk platforms 198 are mounted on the scaffolding support 10, the platforms 198 will abut closely to one another, being separated only by the width 238 of the gusset 230.

Figure 4:
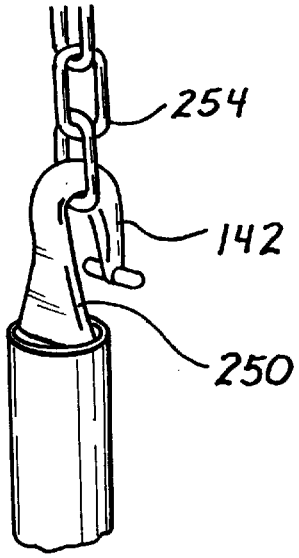
FIG. 4 is a perspective detail illustrating the connection means used to support the FIG. 1 embodiment.

In yet a further variant, illustrated in FIG. 4, the first 138 and second 142 connection means include hooks 250 for attachment to suspension chains 254.

Figure 5:
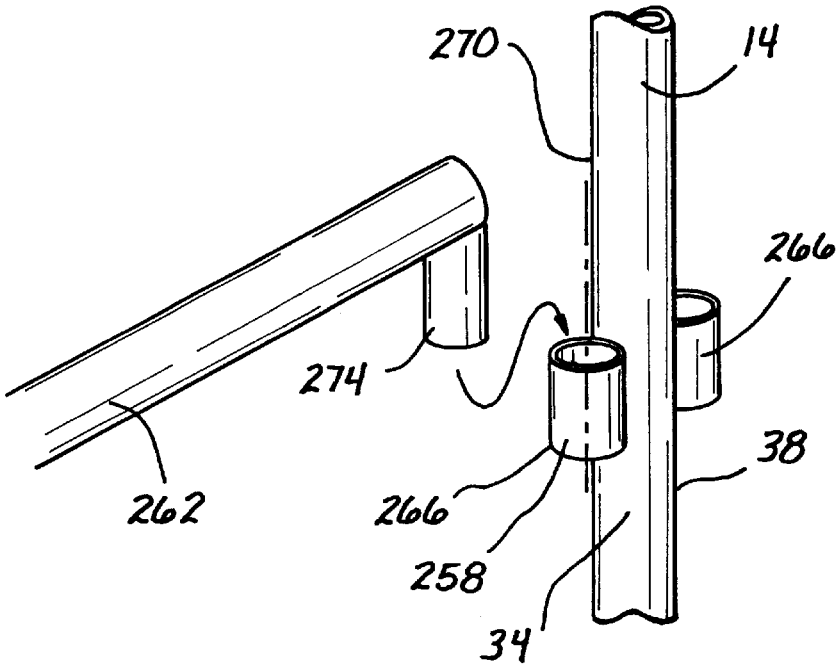
FIG. 5 is a perspective detail of the safety railing and the means for attaching same.

A further variant of the invention, illustrated in FIGS. 2 and 5, includes means 258 for attaching safety railings 262 to the rear upright 14 and to the center upright 42.

In still a further variant, the means 258 for attaching safety railings 262 to the rear upright 14 and to the center upright 42 further includes a series of tubes 266. The tubes 266 have a longitudinal axis 270 and are fixedly attached to the first 34, 66 and second 38, 70 side surfaces of the rear 14 and center 42 uprights. The tubes 266 are sized, shaped and located to accommodate a series of brackets 274. The brackets 274 are sized and shaped to support the safety railings 266. When the brackets 274 are located in the tubes 266, a series of safety railings 278 is removably supported by the rear 14 and center uprights 42.

In a final variant of the invention, illustrated in FIGS. 1–3, the first 190 and second 194 restraining means further include a U-shaped bracket 282. The bracket 282 has first 286 and second 290 side portions and a base portion 294. The side portions 286, 290 have a first end 298 and a second end 302, and are pivotally mounted to each of the rear upright 14 and the lower reinforcing strut 158 adjacent the first ends 298 of the side portions 286, 290. The bracket 282 includes a series of orifices 306 in the base portion 294. The orifices 306 are sized, shaped and located to accommodate nails 310 for securing the bracket 282 to a catwalk 198. When the catwalk 198 is positioned upon the lower connecting platform 110, the brackets 282 pivoted downwardly to contact the catwalk 198 and nails 310 are driven through the orifices 306 and into the catwalk 198, the catwalk 198 will be secured from movement with respect to the scaffolding support 10.

The scaffolding support 10 has been described with reference to particular embodiments. Other modifications and enhancements can be made without departing from the spirit and scope of the claims that follow.

What is claimed is:

1. A scaffolding support, comprising:

a rear upright member, said rear upright having a first predetermined length, an upper end, a lower end, an inner side, an outer side, and first and second side surfaces;

a center upright member, said center upright having a second predetermined length less than the first predetermined length, an upper end, a lower end, an inner side, an outer side, first and second side surfaces and being spaced from and parallel to said rear upright;

an upper connecting member, said upper member having a first end, a second end and being fixedly attached at its first end adjacent the upper end of the rear upright and being fixedly attached between its first end and its second end to the upper end of the center upright;

a front upright member, said front upright having a third predetermined length less than the first predetermined length, a first end, a second end, an inner side, an outer side and being parallel to the center upright;

a lower connecting platform, said lower platform having an upper surface, a lower surface, a first end, a second end and being fixedly attached at its first end adjacent the lower end of the rear upright and being fixedly attached at its second end to the second end of the front upright;

means for attaching the lower end of the center upright to the lower connecting platform between its first end and its second end;

first and second connection means, said first connection means being fixedly attached at the upper end of the rear upright, said second connection means being fixedly attached adjacent the second end of the upper connecting member;

an upper reinforcing strut, said upper strut extending from a first point adjacent the second end of the upper connecting member to a second point between the upper end of the center upright and the lower end of the center upright;

a lower reinforcing strut, said lower strut having a first end and a second end and extending from a third point adjacent the second end of the front upright to a fourth point between the lower end of the center upright and the upper end of the center upright, said fourth point being spaced from said second point;

a horizontal reinforcing strut, said horizontal strut extending from a fifth point disposed between the first end of the front upright and the second end of the front upright to a sixth point disposed between the first end and the second end of the lower reinforcing strut;

first and second restraining means, said first restraining means being pivotally mounted adjacent the lower end of the rear upright, said second restraining means being pivotally mounted adjacent the second end of the front upright; and whereby, when at least two of said scaffolding supports are suspended from their connection means parallel to each other and spaced from one another by the length of a catwalk platform, the catwalk platform is disposed upon the lower connecting platform between the rear upright and the front upright and secured thereto by the restraining means, thereby forming a stable platform, a track system is secured to the catwalk platform between the center upright and the front upright, thereby permitting recording equipment to be moved on the track system past the center upright without interference.

2. A scaffolding support as described in claim 1, wherein the lower connecting platform further comprises:

a first attachment plate, said first plate being fixedly attached to the inner side of the rear upright perpendicular to the upper connecting member;

a second attachment plate, said second plate being fixedly attached to the inner side of the front upright perpendicular to the upper connecting member; and at least one support member, said support member having a first end, a second end, and being fixedly attached between the first attachment plate and the second attachment plate, parallel to the upper connecting member.

3. A scaffolding support as described in claim 1, wherein the means for attaching the lower end of the center upright to the lower connecting platform further comprises:

a gusset, said gusset being formed of plate material of a first predetermined width, having a vertical edge and an orthogonal horizontal edge and being fixedly attached at its vertical edge to one of the inner side and the outer side of the center upright and being fixedly attached at its horizontal edge to the upper surface of the lower connecting platform; and whereby, when adjacent catwalk platforms are mounted on the scaffolding support, the catwalk platforms will abut closely to one another, being separated only by the width of the gusset.

4. A scaffolding support as described in claim 1, wherein the first and second connection means comprise hooks for attachment to suspension chains.

5. A scaffolding support as described in claim 1, further comprising means for attaching safety railings to the rear upright and to the center upright.

6. A scaffolding support as described in claim 5, wherein the means for attaching safety railings to the rear upright and to the center upright further comprises:

a series of tubes, said tubes having a longitudinal axis and being fixedly attached to the firsthand second side surfaces of the rear and center uprights;

said tubes being sized, shaped and disposed to accommodate a series of brackets, said brackets sized and shaped to support the safety railings; and whereby, when the brackets are disposed in the tubes, a series of safety railings is removably supported by the rear and center uprights.

7. A scaffolding support as described in claim 1, wherein the first and second restraining means further comprise:

a U-shaped bracket, said bracket having first and second side portions and a base portion, said side portions having a first end and a second end, and being pivotally mounted to one of the rear upright and the lower reinforcing strut adjacent said first ends of said side portions;

said bracket including a series of orifices in said base portion, said orifices being sized, shaped and disposed to accommodate nails for securing the bracket to a catwalk; and whereby, when the catwalk platform is positioned upon the lower connecting platform, the brackets pivoted downwardly to contact the catwalk platform, and nails are driven through the orifices and into the catwalk platform, the catwalk platform will be secured from movement with respect to the scaffolding support.

* * * * *